United States Patent [19]

Szegi

[11] 4,325,651

[45] Apr. 20, 1982

[54] PROTECTED TRAFFIC CONTROLLER SPIKES

[76] Inventor: Alexander Szegi, 3915 Calle Cita, Santa Barbara, Calif. 93110

[21] Appl. No.: 196,214

[22] Filed: Oct. 14, 1980

[51] Int. Cl.[3] ..... E01F 13/00

[52] U.S. Cl. ..... 404/6; 404/11; 49/49; 256/16

[58] Field of Search ..... 404/6, 9, 11; 256/15, 256/16, 18, 17, 14; 49/49

[56] References Cited

U.S. PATENT DOCUMENTS

| | | | |
|---|---|---|---|
| 1,017,529 | 2/1912 | Gabrielsen | 256/16 |
| 1,527,107 | 2/1925 | Allen | 404/6 |
| 2,762,145 | 9/1956 | Rupe | 49/49 |
| 2,918,740 | 12/1959 | Smith | 49/49 |
| 3,325,782 | 6/1967 | Der | 49/49 |
| 3,783,558 | 1/1974 | Keator | 49/49 |
| 4,016,679 | 4/1977 | Ellefson | 49/49 |
| 4,097,170 | 6/1978 | Dickinson | 404/6 |
| 4,101,235 | 7/1978 | Nelson | 404/6 |
| 4,158,514 | 6/1979 | Dickinson | 404/6 |

*Primary Examiner*—Nile C. Byers, Jr.
*Attorney, Agent, or Firm*—Harry W. Brelsford

[57] ABSTRACT

The inclined projecting spikes used by parking lots to discourage entrance through the exit are guarded for protection of pedestrians. The guards take the form of either shrouds over the spikes or movable members disposed near the point of the spikes and spring-biased so that the guards will not deflect under the weight of a pedestrian's foot, but will deflect under the weight of an automobile wheel to thereby expose the spikes and deter runaway entry into the exit of a parking lot.

8 Claims, 11 Drawing Figures

PROTECTED TRAFFIC CONTROLLER SPIKES

My invention relates to traffic controller spikes, or teeth, of the type placed across the exits of automobile parking lots or parking structures and that present teeth or spikes to the tires of automobiles that enter the wrong way through the exit. More particularly, my invention relates to guards or shrouds for such teeth or spikes to prevent injury to pedestrians that might walk or fall upon the spikes and which yet function effectively to present tire-menacing teeth or spikes to automobiles that enter the wrong direction in an exit lane so equipped.

BACKGROUND OF THE INVENTION

Many commercial parking lots or parking structures have separate entry lanes or roadways for automobiles and separate exit lanes. To prevent unauthorized entry through the exit lane it is common to provide hinged teeth that normally incline toward an incoming vehicle, but incline away from an outgoing vehicle. An outgoing vehicle drives over the spikes, whereupon they rotate to a horizontal position and the exiting automobile is not damaged. An automobile entering the exit the wrong way runs into the inclined spikes, which do not rotate further, thus puncturing the tires of such automobiles. The threat of tire damage is very visible, and such traffic controllers are very effective in preventing unauthorized entry.

The projecting spikes, however, present a safety hazard to pedestrians, including children at play, persons having sight impairment, and nighttime pedestrians. Not only are pedestrians tripped by the spikes, sustaining injury from a fall, but persons who fall on the spikes might well sustain fatal puncture wounds.

BRIEF SUMMARY OF THE INVENTION

I have devised safety structure for traffic control spikes to protect pedestrians. One form is in the nature of a spring-biased deflectable guard on the side away from the exiting traffic. This guard terminates at the upper tip of the spike so that the tip is not projecting. The spring is so calibrated that the guard remains in place under the weight of a person, but when an automobile wheel runs over it the guard is deflected, exposing the tip of the spike. Another form of the invention employs an elastic shroud, prefereably of spring metal, that has one slot for each spike. The shroud normally covers the spikes, even when a person walks on it. The spring calibration of the shroud is selected, however, to flatten out under the weight of an automobile, and this exposes the upward projecting spikes in the shroud slots.

Various objects, advantages, and features of the invention will be apparent in the following description and claims, considered together with the drawings forming an integral part of this specification and in which:

Figure 1:
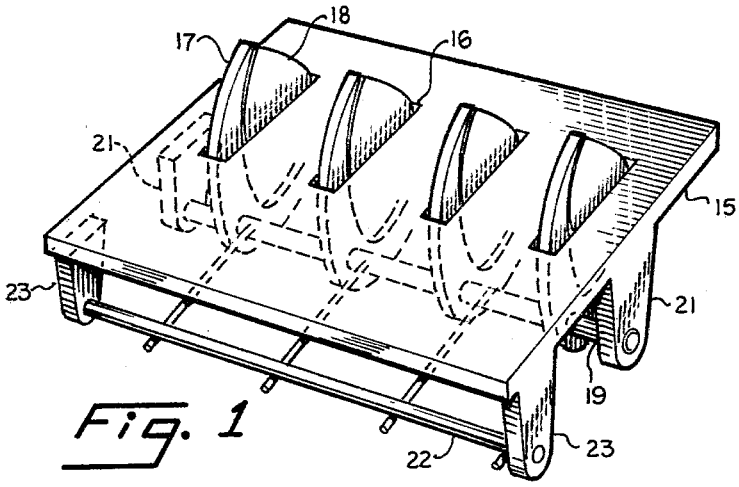
FIG. 1 is a three-dimensional view of a plate in a roadway or exit from a parking structure showing a plurality of traffic control spikes guarded by a hinged guard.

Referring now to FIG. 1, there is illustrated a plate 15 of steel or other material having a plurality of slots 16 in which project spikes 17 and guards 18. The spikes are mounted on a rotatable shaft 19 journaled in journal blocks 21 secured to the underside of the plate 15, and the guards 18 are mounted for rotation on the spikes 17 as will be described hereafter. Also secured on the underside of the plate 15 is a spring bar 22 mounted in blocks 23.

Figure 2:
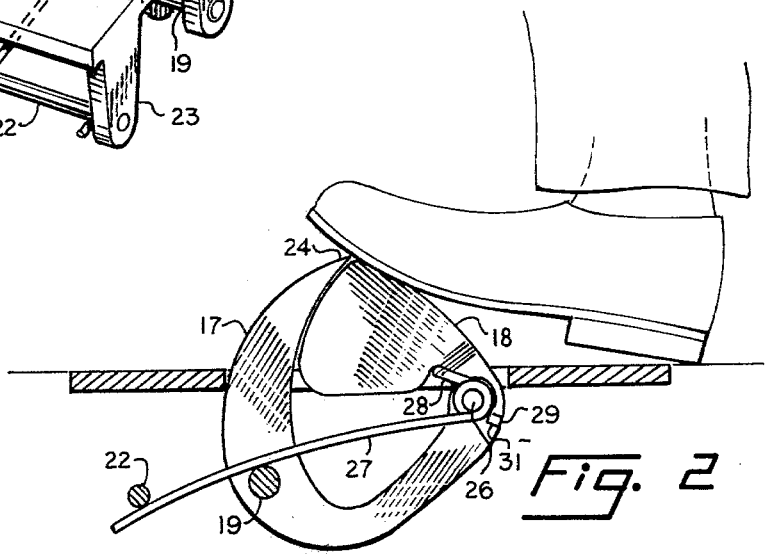
FIG. 2 is an elevational view of one of the spikes of FIG. 1 showing the guard supporting the weight of a pedestrian's foot.

Referring now to FIG. 2, there is illustrated a structure in more detail of the spikes 17 and the guard 18. The spikes 17 may have upward projecting points 24. The spike is generally U-shaped, having its central portion mounted on the rotatable shaft 19 and having a pivot pin 26 mounted on the end of the U-shape opposite from the point 24. Pivoted on the pin 26 is the rotatable guard 18, and this guard 18 is urged in a clockwise direction as viewed in FIG. 2 by a spring 27 having a midportion resting on the shaft 19 having its left outer end engaging the spring rod 22 and having its other end engaging a notch 28 in the guard 18. The clockwise rotation of the guard 18 is limited by means of a lug 29 bent over from the right-hand edge of the guard 18, and this lug engages a step 31 on the U-shaped spike 17.

The spring 27 not only urges the guard 18 to a clockwise position, but also holds the spike 17 in the upright position illustrated in FIG. 2. The spring's strength or rate of the spring 27 is so selected that the guard 18 will not depress under the weight of the pedestrian's foot. Assuming that a pedestrian places all his weight on the guard 18, the spring rate should be such that the guard 18 does not depress under weights of two hundred pounds or less. The guard 18 should, however, depress under weights encountered by a pedestrian's foot or by an automobile tire striking it from the left. The force necessary to overcome the spring 27 from the left may be any desired amount, such as twenty-five pounds. The spring 27 for this purpose need only to be strong enough to return the spike 17 to an upright position. Accordingly, the spring rate for spring 27 should be such that the spike 17 may rotate in a clockwise direction as viewed in FIG. 2 when a slight weight is placed upon it from the left.

Figure 3:
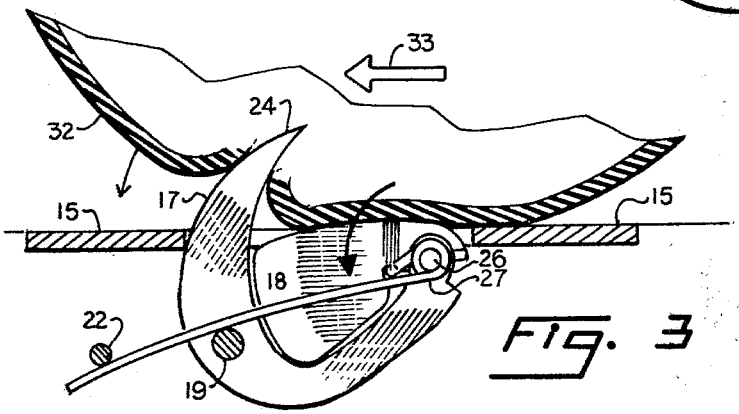
FIG. 3 is a view of the spike of FIG. 2 with an automobile wheel deflecting the guard and thereby exposing the sharp point of the spike for puncturing the tire of a vehicle entering the roadway from the wrong direction.

This deflection of guard 18 is illustrated in FIG. 3, wherein a vehicle tire 32 moves in the direction of the arrow 33, which is the wrong direction for the traffic control spike 17. The weight of the tire 32 being in excess of two hundred pounds and probably closer to six hundred pounds for the front end of a front-engine automobile, the guard 18 will fully depress to the position illustrated in FIG. 3, whereupon the spike tip 24 will project into the tire 32 and puncture the same or at least give threat of a puncture, depending on the strength of the tire. The counterclockwise rotation of the spike 17 on its shaft 19 is limited by striking the steel plate 15.

Figure 4:
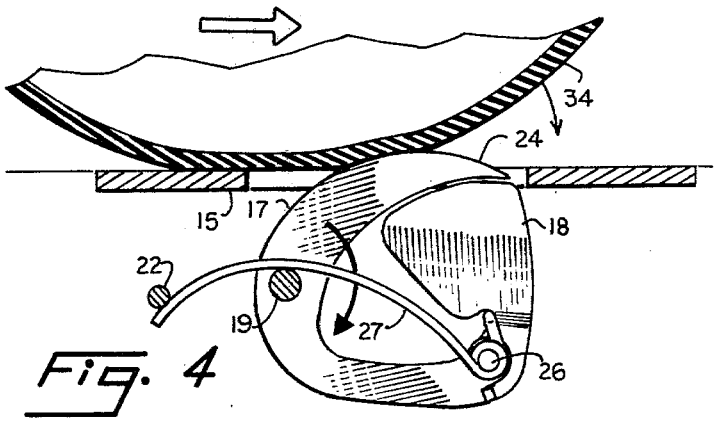
FIG. 4 is an elevation view of the device of FIG. 1 showing the rotation of the spike to a horizontal position when it is struck by a tire from the vehicle moving in the correct exiting direction from the parking lot or other controlled area.

The action of the spike and associated guard 18 when it is run over by an automobile moving in the correct direction is illustrated in FIG. 4, and there it will be noted that a wheel 34 striking the upright spike 17 of FIGS. 1 and 2 will cause the spike 17 to rotate about the axis of the shaft 19 to a generally horizontal position. At the position shown in FIG. 4, the tire 34 can safely roll over the point 24 without any damage.

Figure 5:
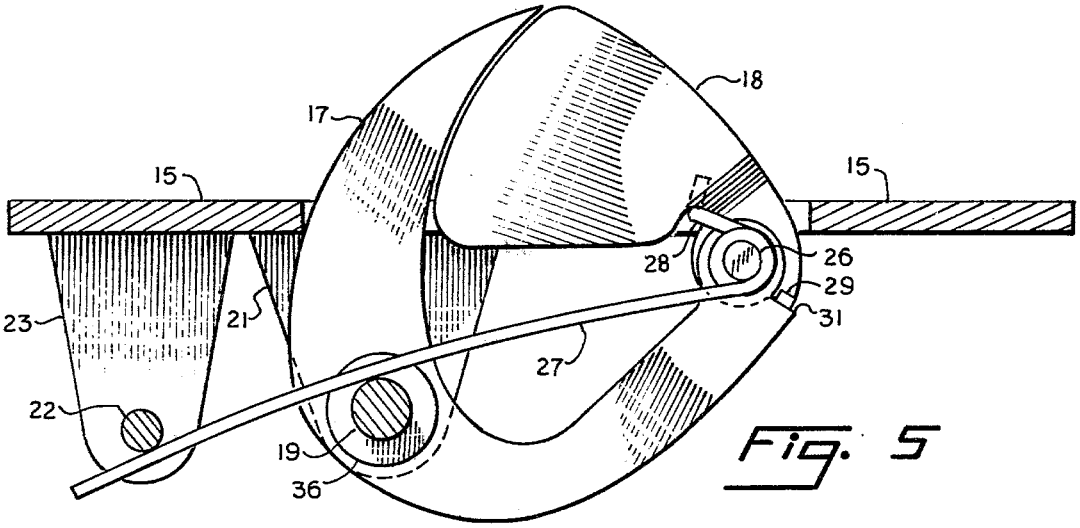
FIG. 5 is an elevation view of the combined spike and guard of FIG. 2 on an enlarged scale.
Figure 6:
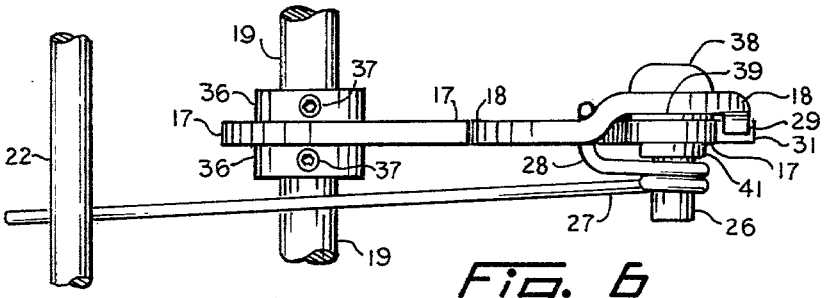
FIG. 6 is a plan view of the combined spike and guard of FIG. 5.

Referring to FIG. 5, there is illustrated the structure of FIGS. 2, 3, and 4 on an enlarged scale, and the plan view is shown in FIG. 6.

Referring now particularly to FIG. 6, it will be noted that the spike 17 is held in position on the shaft 19 by a pair of collars 36 having setscrews 37 to secure them to the shaft 19. The pivot structure for the guard 18 is also illustrated in FIG. 6, and I presently prefer to have the pin 26 in the form of a rivet having a head 36 wherein the shaft 26 of the rivet has a drive fit or friction fit in the spike body 17. Washers 39 and 41 may separate the guard 18 and the spike 17 and separate the spike 17 from the spring 27, respectively. In this fashion the guard 18 is readily and securely pivoted to the spike structure 17.

Figure 7:
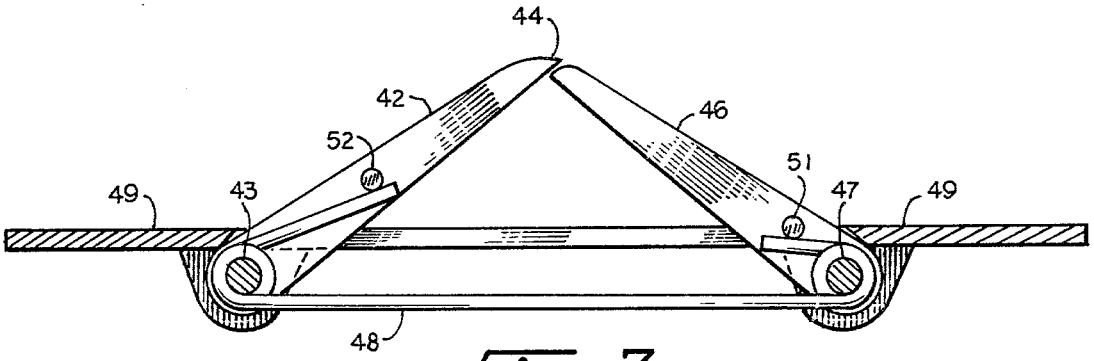
FIG. 7 is a schematic view of a simplified form of the invention showing a spike and guard.

Referring now to FIG. 7, there is illustrated a simplified form of the invention wherein an inclined spike 42 is mounted for rotation at 43 and has an upper tip 44. A guard 46 is also mounted for rotation about an axis 47, and its upper end is disposed adjacent the tip 44. A spring 48 urges the spike 42 in a counterclockwise direction, and this rotation is stopped by a plate 49. The same spring 48 urges the guard 46 in a clockwise direction, and this rotation is stopped by the same plate 49. Near the guard axis 47 the spring engages an outward projecting pin 51, and the opposite end of the spring 48 engages a pin 52. Therefore, when an automobile tire moves to the left in FIG. 7, the guard 46 will be depressed, but the spike 42 will retain its inclined position that threatens to puncture the tire of an incoming vehicle. When an automobile tire moves to the right in FIG. 6, it will move the spike 42 downward and its tip 44 will engage the guard 46 to force it down toward the horizontal position also so that an exiting vehicle can run smoothly over the plate 49 without damaging its tire.

Figure 8:
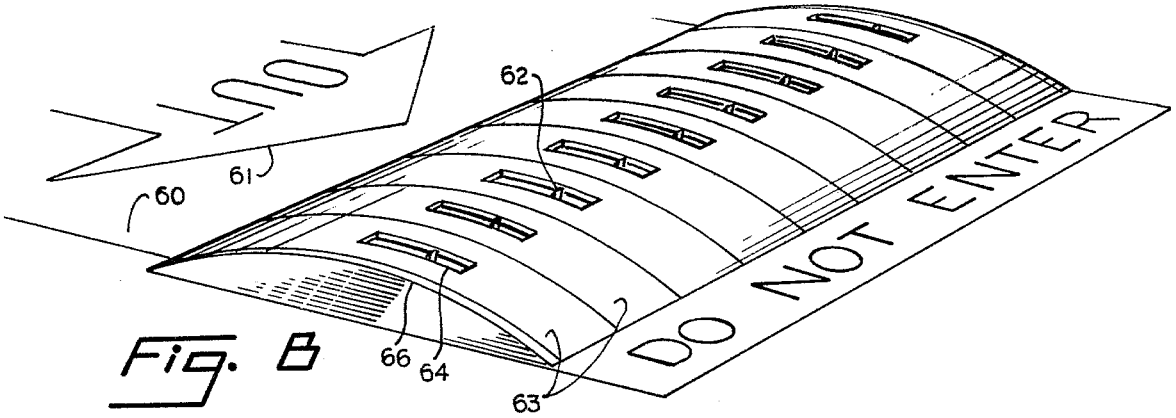
FIG. 8 is a three-dimensional view of a plurality of traffic control spikes, each having a protective shroud disposed over them to prevent injury to pedestrians.

Referring now to FIG. 8, there is illustrated a guard for traffic control spikes which is in the nature of a shroud. An automobile roadway 60 has a normal exiting direction as shown by the arrow 61, and disposed across this roadway 60 is a plurality of spikes 62 that are normally in an upright position. Disposed over each spike is a slotted strip of spring metal 63, each having a slot 64 over the spike with sufficient length to allow free movement of the spike in the exiting direction of the arrow 61. The spring plates 63 are curved, forming a hump 66 at the region of the tips of the spikes 62. When an automobile exits in the direction of the arrow 61, the spring plates 63 are flattened and the vehicle wheel thereupon contacts a spike 62, which thereupon rotates in a clockwise direction as viewed in FIG. 8 to a generally horizontal position where the spike will not injure the tire. If, however, a vehicle rides over the spring plate 63 in a direction opposite that of the arrow 61, the spring plate 63 will flatten and expose the tips of the spike 62, thus threatening to puncture the tire of an automobile driving against the traffic direction indicator 61.

Figure 9:
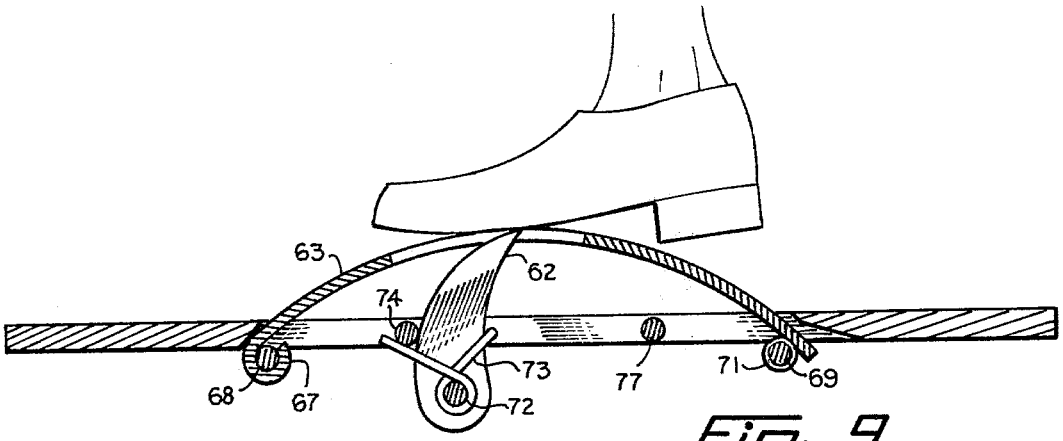
FIG. 9 is an elevation view of one of the shrouds of FIG. 8, together with one of the spike mechanisms of FIG. 8, and showing the shroud, but not deflecting under the weight of a pedestrian's foot.
Figure 10:
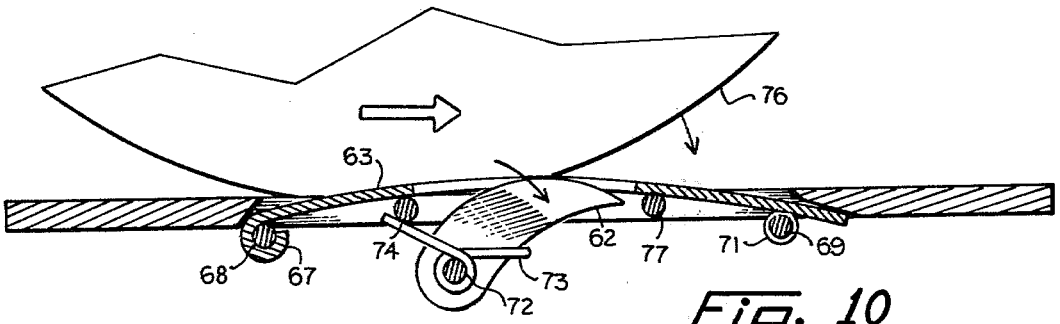
FIG. 10 is an elevation view of the device of FIG. 9 when it is run over by a vehicle moving in the correct exiting position, whereupon the spike deflects toward the horizontal.
Figure 11:
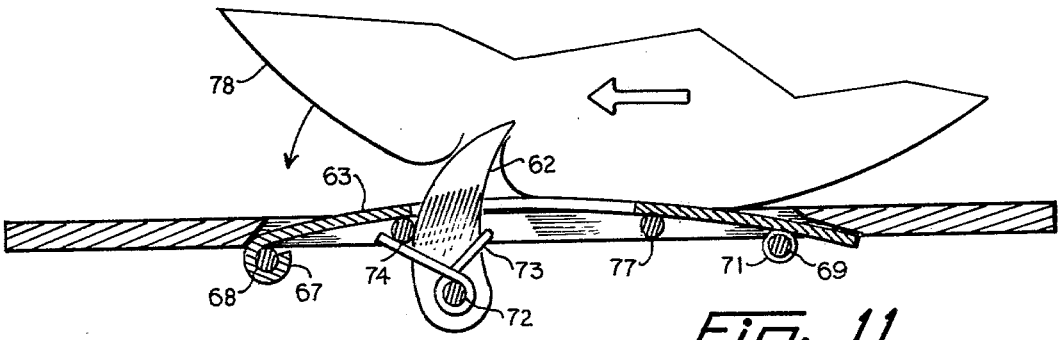
FIG. 11 is an elevation view of the device of FIG. 9 showing the shroud deflected by the weight of a vehicle wheel and showing the upright spike when the vehicle is moving in the wrong direction in the roadway.

Referring now to FIGS. 9, 10, and 11, it will be noted that the left-hand end of the spring plate 63 is curled at 67 to slip over a shaft 68 about which that end of the spring plate 63 may rotate. The right-end of the spring plate 63 is supported by a rod 69 about which is placed a tube 71 to act as a roller to reduce friction when the spring plate 63 is flattened. The spikes 62 are mounted for rotation on a shaft 72, and any suitable spring such as spring 73 may urge the spike 62 in a counterclockwise direction until it is stopped by a stop bar 74. The spring rate of the strip 63 is so selected that it will not appreciably deflect under the weight of a pedestrian, for example, two hundred pounds or less, but will deflect on weights greater than that so that it will completely deflect with weights in the range of four hundred to six hundred pounds.

The deflection of the plate by a properly exiting vehicle is illustrated in FIG. 10, wherein an automobile tire 76 passing over the plate 63 causes it to flatten to a generally horizontal position where it is supported by its hinge bar 68, the stop bar 74, a support bar 77, and the roller bar 69. The automobile wheel striking the spike 62 causes it to rotate in a clockwise direction to that illustrated in FIG. 10, at which position it is generally horizontal and therefore will not injure the tire 76.

The deflection of the plate 63 by an automobile tire entering the structure in the wrong direction is illustrated in FIG. 11. There an automobile tire 78 causes the plate 63 to deflect the same flat position illustrated in FIG. 10, but in this case the point of the spike 62 is encountered by the tire and the point poses a threat of puncture to the tire. The spike 62 will retain its upright position because it rests against the stop bar 74.

It will be appreciated by those skilled in the art that various kinds of structures may be used with the guard FIGS. 1 through 7. I prefer to make my guard 18 of fairly sizable body as illustrated in FIGS. 1 through 6 so that a person could not interrupt their functioning by putting a stick underneath the guard as is possible with the structure of FIG. 7. As will be noted in FIG. 1, the guards 18 fill substantially all the space between the top of the guards and the plate 15. In this case it is not possible to put any rod or bar or stick in the structure to cause it to malfunction.

The shroud structure of FIGS. 8 through 11 is similarly free from any sabotage that might cause it to malfunction, especially if the ends of the plates 63 are enclosed with a concrete curve, a metal flange, etc., so that there is no access to the interior.

Various modifications and improvements will be apparent to those skilled in the art. For example, the guards could straddle the spike or one guard could be placed to one side of a spike. Additionally, the guard and spike may be mounted on the same shaft for independent rotation. I have illustrated in the drawings the presently preferred embodiments of my invention as required by the patent statutes. Accordingly, all variations, modifications, and improvements that fall within the true spirit and scope of the invention are included within the scope of the following claims.

I claim:

1. An assembly of a pivoted traffic control spike in an automobile roadway and a pedestrian guard for the spike, comprising:

(a) an upward projecting spike;

(b) pivot means for the spike to limit rotation about an axis in one direction and to permit rotation toward the horizontal in the other direction;

(c) an upwardly inclined projecting guard having an upper end disposed adjacent to the spike's upper end;

(d) pivot means for the guard to limit rotation in one direction about an axis and to permit rotation to the horizontal in the other direction;

(e) and spring means connected to the guard, normally urging it in the inclined projecting position, having a strength to sustain the weight of a pedestrian, but to deflect under the weight of an automobile wheel.

2. An assembly as set forth in claim 1 wherein the axis of the spike pivot means is parallel to the guard pivot means.

3. An assembly as set forth in claim 1 wherein the spike is normally at an incline to form an acute angle and the guard is disposed opposite the acute angle of the spike.

4. An assembly of a pivoted traffic control spike in an automobile roadway and a guard for the spike, comprising:

(a) a spike normally projecting above the roadway and having an upper tip;

(b) pivot means for the spike allowing rotation in one direction from a projecting position to a flattened position;

(c) means limiting rotation of the spike in the other direction;

(d) an upwardly inclined guard having an upper end disposed adjacent to the spike's upper tip;

(e) means mounting the guard on the spike for rotation relative to the spike;

(f) means for limiting the upward rotation of the guard;

(g) and spring means urging the guard to a projecting position and having a strength to support a pedestrian on the guard, but deflecting under the weight of an automobile wheel, whereby the spike rotates in said one direction when struck by an exiting vehicle and the guard rotates toward a horizontal position when an automobile enters the other direction, to expose the spike's upper tip.

5. An assembly of a spike and guard as set forth in claim 4 wherein the spring means also rotates the spike to its upright position.

6. In assembly with a pivoted and normally projecting traffic control spike projecting above an automobile roadway, a pedestrian safety shroud, comprising a sheet of elastic material disposed on the roadway over the spike and having a hump in the region of the spike approximately the height of the spike and having a slot over the spike, said elastic material having a spring rate preventing deflection under the weight of a pedestrian, but deflecting under the weight of an automobile wheel to thereby expose the spike for traffic control.

7. An assembly as set forth in claim 6 wherein the spike is pivoted and means are provided for limiting rotation in one direction from the projecting position and for permitting rotation toward the horizontal in the other direction.

8. An assembly as set forth in claim 6 wherein there is provided spring means for normally holding the spike in its projecting position.

* * * * *